US005517008A

United States Patent [19]

Francart, Jr.

[11] Patent Number: 5,517,008

[45] Date of Patent: May 14, 1996

[54] STEAM POWERED LIQUID PUMP MECHANICAL CYCLE COUNTER

[75] Inventor: Armand Francart, Jr., Landenberg, Pa.

[73] Assignee: Eastern Machine, Inc., Landenberg, Pa.

[21] Appl. No.: 225,986

[22] Filed: Apr. 12, 1994

[51] Int. Cl.[6] ..... G06M 1/00

[52] U.S. Cl. ..... 235/91 F

[58] Field of Search ..... 235/91 F, 91 R, 235/94 R

[56] References Cited

U.S. PATENT DOCUMENTS

| | | | |
|---|---|---|---|
| 1,357,361 | 11/1920 | Stuber | 235/91 F |
| 1,992,991 | 3/1935 | Colley | 235/91 F |

*Primary Examiner*—Cassandra C. Spyrou
*Attorney, Agent, or Firm*—Sughrue, Mion, Zinn, Macpeak & Seas

[57] ABSTRACT

A mechanical cycle counter incorporates a cast aluminum, thermal isolating upwardly open connector coupled to a steam powered cyclic actuator depending stainless steel cylinder closed off at opposite ends by stainless steel end caps. A disk-like piston slides interiorly of the cylinder and is extended by a piston rod upwardly through the cylinder and through a hole within the bottom of the connector. A mechanical counter oscillation arm rotates approximately sixty degrees and is mounted to a shaft bearing a plurality of rotary wheels. A horizontal portion of the oscillation arm is in the path of the projecting end of the piston rod. A chamber beneath the piston and above the lower end cap receives steam. A stainless steel coil spring concentrically surrounds the piston rod and has one end abutting the piston and the opposite end abutting the upper end cap. A rise in steam pressure causes the piston to compress the coil spring driving the projecting end of the piston rod momentarily against the horizontal portion of the oscillation arm to cyclically increment the mechanical counter. Various stainless steel parts thermally isolate the actuator from the counter.

6 Claims, 2 Drawing Sheets

STEAM POWERED LIQUID PUMP MECHANICAL CYCLE COUNTER

FIELD OF THE INVENTION

This invention relates to mechanical counters in combination with a steam actuator and more particularly, to such steam actuated mechanical cycle counters particularly employed for counting cycles of operation of a steam powered liquid pump.

BACKGROUND OF THE INVENTION

The Applicant has produced a highly effective steam powered liquid pump for pumping liquids accumulating within a housing or reservoir which fills over time, and which is cyclically discharged by steam or other high pressure gas as an actuating fluid based on accumulation of such liquid to a predetermined level within the reservoir. As such steam powered liquid pump using an over center valve actuating mechanism is the subject of U.S. Pat. No. 5,141,405, issued Aug. 25, 1992 and entitled LEAK PROOF, PRELOADED, HIGH-BIASING FORCE FLOAT-OPERATED OVER CENTER VALVE ACTUATING MECHANISM.

Steam or gas powered liquid pumps of this type include a float actuator mechanically coupled to a spring-biased over center toggle linkage controlling the position of a pair of valve actuators for controlling alternatively, feeding high pressure gas to the interior of the container or reservoir, and for effecting discharge of the accumulated liquid by the pressure of the steam or other pressurized gas above the level of the accumulated liquid within the reservoir. As the over center linkage passes through an in line centered position, one valve closes and the other opens. Such steam or gas powered liquid pump may operate at hundreds of thousands of cycles or millions of cycles over the life of the pump. Further, not only is the steam or other pressurized gas corrosive to the pump components and the over center valve actuating mechanism, but the liquid being pumped may vary from water, to a highly volatile liquid such as a liquid hydrocarbon.

Attempts have been made to count the cycles of operation of such steam or gas powered liquid pumps. Digital counters require electrical energy, either DC or AC, and where the steam or gas powered liquid pumps function to pump a highly volatile liquid, there is always the danger of spark ignition of such volatile liquids. Further, where the liquid being pumped is highly corrosive, the corrosive fluids, whether the pressurized gas powering the liquid pump or the liquid being pumped, may corrode the electrical or mechanical counter mechanisms to the extent where they become inoperable or impair the ability of the counter to provide an accurate account. Where steam provides the pressurized gas for powering the liquid pump, steam may be at temperatures in excess of 400 or 500 degrees Fahrenheit, and steam pressures within the vessel or reservoir may be in excess of 250 psi. The temperature of the pressurized gas or steam powering liquid pump in the past have tended to interfere with the actuator for either a mechanical cycle counter or its electrical counterpart, or both. The mechanical counters particularly in the past have been inadequately insulated thermally from the source of the gas pressure for operating the liquid pump resulting in failure of the mechanical or electrical counters over time.

It is therefore a primary object of the invention to provide an improved steam powered liquid pump mechanical cycle counter, which is formed of components of high strength, which have low heat transmission capability, which are corrosion proof, and in which the moving elements of the actuator are adequately sealed to prevent escape of the pressurized gas or steam functioning to power the liquid pump and which acts to power the actuator for the mechanical cycle counter.

BRIEF DESCRIPTION OF THE DRAWINGS

FIG. 4 is a vertical sectional view of a modified mechanical counting apparatus forming a second embodiment of the invention which includes a magnetic sensor limit switch providing electrical pulses to a compute or the like.

DESCRIPTION OF THE PREFERRED EMBODIMENTS

Figure 2:
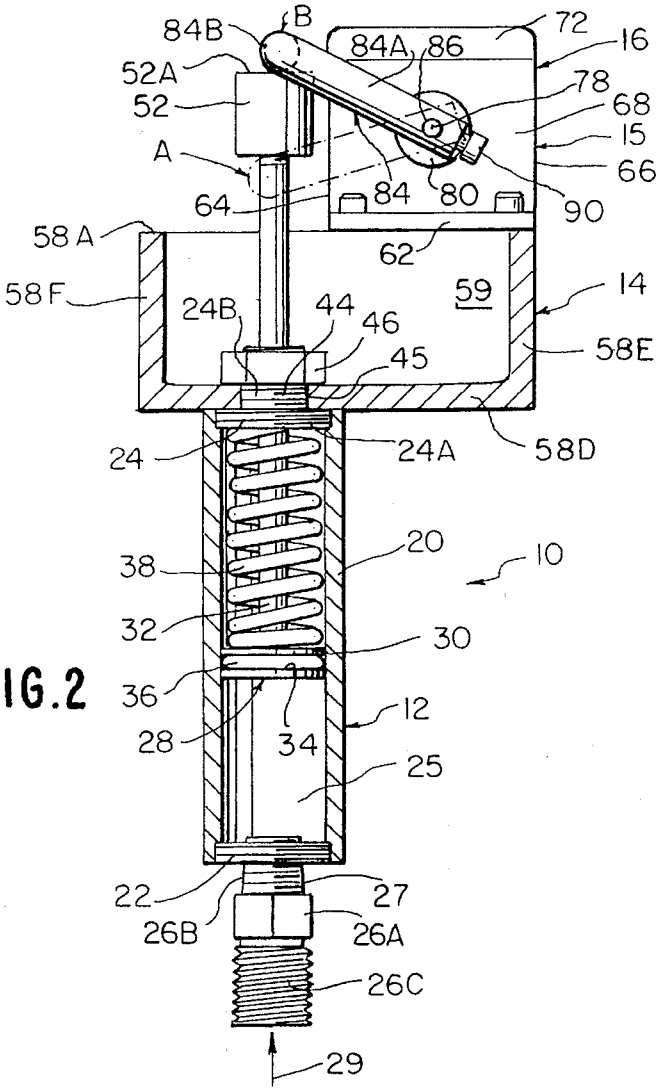
FIG. 2 is a side elevational sectional view of the mechanical cycle counter of FIG. 1.
Figure 1:
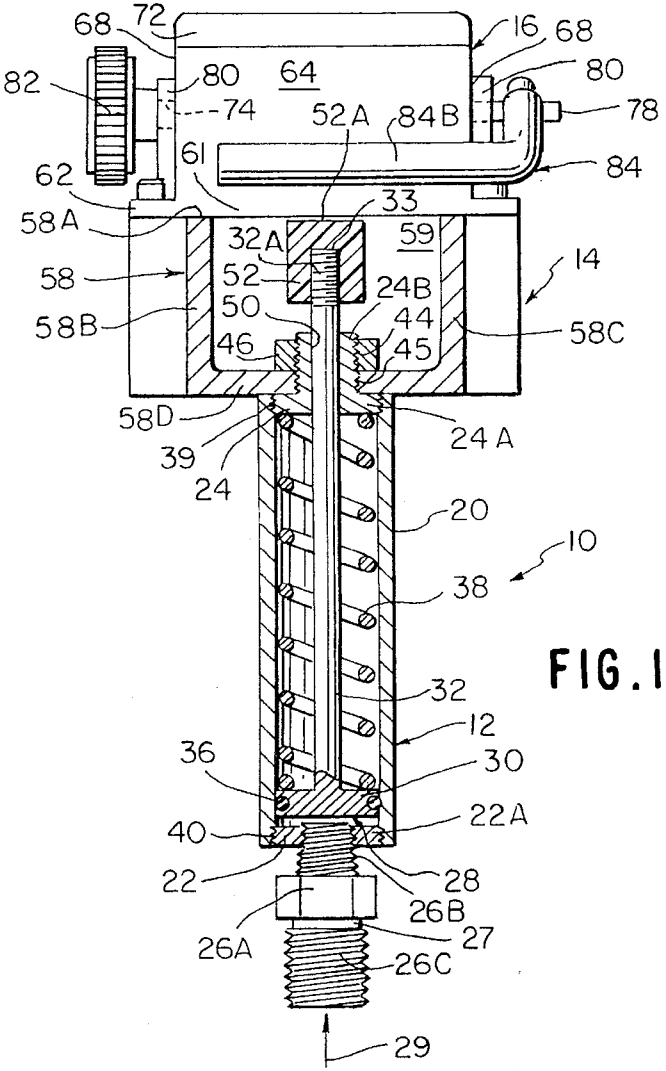
FIG. 1 is a front elevational view of a steam powered liquid pump mechanical cycle counter forming a preferred embodiment of the invention, partially in section to illustrate the interior of the mechanical cycle counter actuator.
Figure 3:
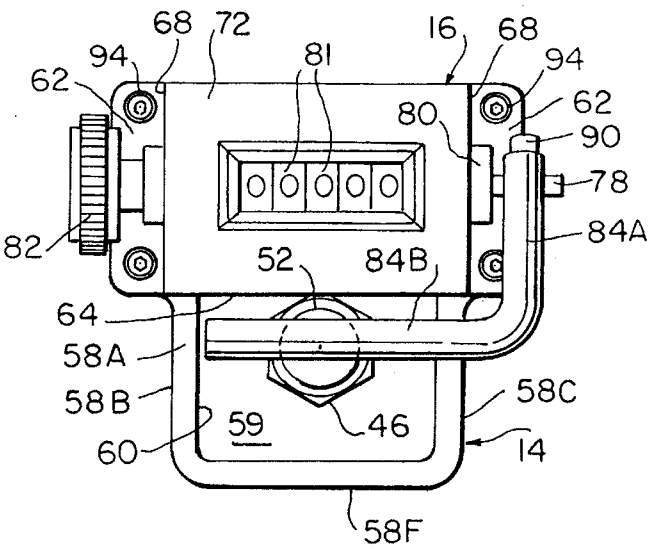
FIG. 3 is a top plan view of the mechanical counting apparatus of FIG. 1.

Referring to FIGS. 1–3 inclusive, a first embodiment of the mechanical counting apparatus of the invention is illustrated generally at 10. The mechanical counting apparatus 10 consists of three principal components: a steam or pressurized gas powered cyclic actuator indicated generally at 12, a hollow cast aluminum, thermal isolating block or connector indicated generally at 14, which mounts the cyclic actuator 12 and from which the cyclic actuator 12 depends, and an overlying, mechanical rotary wheel counter indicated generally at 16.

The mechanical counter 16 may be a commercial counter a parallelepiped form which may be manually actuated, of the type sold under the trade name EM 2000. The mechanical counter 16 other than in terms of the structural combination forming the mechanical counting apparatus is not the Applicant's invention.

As discussed above, the mechanical counting apparatus of the invention utilizes the cyclic increase in a pressurized gas such as steam, conventionally employed as the motive fluid in pumping accumulated liquids within a high pressure vessel or reservoir through an over center double valve actuating mechanism which is the subject of Applicant's prior U.S. Pat. No. 5,141,405. Gas pressure or steam pulse applicating switch or switch actuators are known in the art. Typically such actuators involved a diaphragm of disk form or a bellows type. The diaphragm is displaced axially from an at rest, unpressurized position to an extent capable of changing the state of a switch having a switch actuator in abutment with the diaphragm or fixed thereto. Typically, the diaphragm actuators require a spring to press the diaphragm, once expanded back to its normal rest position awaiting further cyclic pressure surge capable of expanding the diaphragm sufficiently to again change the state of the switch in proximity thereto or in contact therewith. Where, such diaphragm actuators operate against a relatively large back pressure, it is necessary to use one or more return springs. In one known type of actuator for counting fluid pressure pulses, a pair of relatively massive return springs are hooked to the arm of the counter to pull the counter arm back into its cradle and to await the next pressure surge to push the diaphragm and actuate the counter arm to count a further cycle of a gas pressurized liquid pump or the like. Because of the short throw of the diaphragm, multiple springs must be employed which have fairly large spring constants to force the diaphragm back into its original position prior to the pressure surge.

The mechanical counting apparatus of the present invention in the various embodiments illustrated in the drawings and described herein constitutes a highly effective, low cost apparatus which will operate under loads of 5,000,000 cycles and above. The mechanical counting apparatus of the present invention is particularly useful where live steam is the motive of the fluid for driving an accumulated liquid out of a pressure vessel or pump reservoir after accumulation of the same, and wherein the gas pressure fluid such as steam overlying the accumulated liquid in the vessel is cyclically charged above the accumulated liquid by opening a gas pressure valve while simultaneously closing an accumulated liquid inlet valve by means of a float operated over center valve toggle linkage valve actuating mechanism. Such gas pressure operated liquid pump is the subject of Applicant's prior issued U.S. Pat. No. 5,141,405 whose content is incorporated herein by specific reference.

The steam powered cyclic actuator 12 forming a principal component of the invention includes an actuator body or cylinder 20 formed preferably of 304 stainless steel which is a poor conductor of heat and which like the other principal components of the cyclic actuator 12 are likewise formed of stainless steel such as ram 28, and end caps 22 and 24 for the cylinder 20. All of these are additionally corrosive resistant to steam and various other pressurized gases for cyclically displacing the ram 28 against the bias of a stainless steel coil spring 38 captured between the piston 30, and the upper end cap 24 of the cyclic actuator 12. The ram 28 consists of a circular disk piston 30 integrally formed with a right angle upstanding piston rod 32 of a length in excess of the axial length of the cylinder 20 with one end 32A passing through a vertical bore 50 of end cap 24 having a reduced diameter, axial extension portion 24B extending upwardly and axially outwardly of the cylindrical disk portion 24A of the end cap 24. Portion 24B bears external threads at 44, received within a tapped hole 45 within the bottom wall 58D of the thermal isolating the hollow, cast aluminum thermal isolating connector or block 14. The axial extension portion 24B of the upper end cap 24 extends some distance into the cavity 59 of the thermal isolating connector or block 14 and has threaded thereto, a nut 46 which acts to lock the hollow cast aluminum thermal isolating connector 14 to the steam powered cyclic actuator 12. The lower end of the cylinder 20 is closed off by the lower end cap 22. Both end caps 24 and 22 are of disk form, and have threaded outer peripheries which thread into tapped threads 39 and 40, respectively, of the internal surface of the cylinder 20. A nipple or steam inlet fitting 27 is provided with a short length, axially centered hex nut portion 26A, an externally threaded reduced diameter portion 26B which is sized to a tapped bore 22A within the lower end cap 22 and which is threaded thereto, and a larger diameter externally threaded axially projecting portion 26C which may be coupled directly to the gas pressurized liquid pump vessel or reservoir (not shown) from which the steam or other pressurized gas emanates as indicated by arrow 29, FIG. 1. Piston 30 has a diameter sized to the inner diameter of the cylinder 20 within which it slides. The piston 30 is provided with a semi-circular recess or groove 34 within the periphery thereof which carries an ethylene propylene O-ring seal 36 having an outside diameter slightly in excess of the inside diameter of the cylinder 20 and an inside diameter equal to that of the semi-cylindrical groove 34 within which it rests. The ethylene propylene O-ring is unaffected by steam and can operate and effectively seal a chamber 25 defined by the piston 30 and the lower end cap 22 while operating at steam or other pressurized gas pressures of 250 psi and at temperatures on the order of 400 degrees Fahrenheit, emanating from gas pressure source indicated schematically by arrow 29. The upper end 32A of the piston rod 32 is threaded as at 33 and to which is threaded a molded plastic cylindrical ram head 52 which may be of NYLON® or the like. The upper face 52A of the ram head 52 makes contact with the horizontal or transverse portion 84B of an L-shaped oscillation arm 84. The ram head 52 functions to further thermally isolate chamber 25 subjected to the steam at approximately 400 degrees Fahrenheit from the mechanical counter 16 fixably mounted to the hollow cast aluminum thermal isolating connector or block 14 on the face of the block opposite that bearing the suspended steam powered cyclic actuator 12.

In FIGS. 1, 2 and 3, it may be seen that the hollow cast aluminum thermal isolating connector or block 14 is of an irregular rectangular plan configuration integral with the bottom wall 58D, opposite side walls 58B, 58C, front wall 58F, rear wall 58E, all of the walls rising to the same vertical height, and forming a common upper edge 58A upon which is mounted, the mechanical counter 16. The mechanical counter 16 is of a width approximately one half the front to rear width of the block or connector 14. As such, a cavity 59 therein is open at the top as at 60, from vertical front wall 58F rearwardly over an extent well beyond the upwardly projecting ram head 52 carried by the piston rod 32 and residing within cavity 59, FIG. 2.

While the mechanical counter 16 is physically mounted to and in fixed position on the hollow thermal isolating connector or block 14 and abutting and having its housing indicated generally at 15 butting the upper edge 58A of the block or connector 15 along both sidewalls 58B, 58C and the rear vertical wall 58E. Both the cast metal connector or block 14 and the counter housing are formed of cast aluminum, and neither of which are good thermal conductors. As a result, while heat is conducted from the steam pressure chamber 25 through the metal components and by convection to the connector or block 14, and thence to the counter housing 15, the die cast metal counter housing 15 will permit operation of the mechanical counter 16 at temperatures on the order of 230 degrees Fahrenheit although the connection between the cylinder 20, of the steam powered cylindrical actuator 12 may see temperatures as high as 400 degrees Fahrenheit. The cast aluminum connector or hollow block 14 functions as a heat sink to assist in thermal isolating, to an appreciable extent, the mechanical counter from the high temperature steam within the steam pressure chamber 25. The die cast counter housing 15 consists of an integrally molded base plate 61, of a lateral width on the order of the enlarged width portion of the cast aluminum block or connector 14, forming a pair of base plate extensions or flanges 62 which extend transversely outwardly of opposed sidewalls 68 of the counter housing, a front wall 64, a rear wall 66, opposite sidewalls 68 and a cover 72. The sidewalls 68 are provided with circular bosses at 80 which project outwardly at the sidewalls and which carry axially aligned circular bores 74 through which project a counter wheel supporting shaft 78 which extends the full transverse width of the mechanical counter. To the left, FIG. 3, the shaft 78 has fixably mounted thereto a knurled counter wheel reset knob 82. To the right, the opposite end of the shaft 78 projects through a transverse bore or hole 86 within the short length, radial arm portion 84A of the oscillation arm 84 whose right angle transverse arm portion 84B extends across and above the opening 60 within the top of the hollow cast aluminum thermal isolating connector or block 14. The L-shaped oscillation arm 84 has a short length tapped axial bore 88 within the radial arm portion 84A which receives a set screw 90. The inner end of the set screw 90 abuts the face of a knurled peripheral surface of the end of the shaft 78 to frictionally lock the oscillation arm 84 to that shaft. The shaft 35 is provided with a series of ratchet wheels 81 bearing numbers from 0 to 9, the wheels 80 may be five or more in number as shown in FIG. 3. The oscillation arm 84 is spring biased by a spring biasing means (not shown) internally of the counter housing 15 for maintaining the arm in a position such that the radial arm portion 84A is downwardly and forwardly oblique and with the transverse arm portion 84B extending across the top of 52A of the ram head 52, but spaced therefrom. The oscillation arm is permitted to rotate approximately 60 degrees from a downwardly and forwardly oblique position to a upwardly and forwardly oblique position. In making that degree of rotation from a spring biased rest dotted line position A as shown in FIG. 2, to a full line position as shown at B, which is the full extent of the stroke of the piston 30 from its full line position of FIG. 2, the first wheel 80 to the right, of FIG. 3 is incremented one number position. This indicates a single cycle of operation of the cyclic actuator 12 against the bias of the stainless steel coil spring 38. Upon termination of the pumping operation of the steam powered liquid pump (not shown) the steam pressure drops sufficiently for the coil spring 38 to return the piston 30 to its lower-most position, FIG. 1. At the termination of the pumping of the accumulated liquid within the vessel or reservoir after steam pressurization of the storage tank or reservoir above the accumulated liquid level within that tank or reservoir, the over center toggle mechanism of the gas pressurized liquid pump opens a liquid inlet valve to the vessel, and closes steam inlet valve to that same vessel interior.

At this point, the apparatus 10 of FIGS. 1–3 is the condition shown in FIGS. 1, 2 and 3. The apparatus is then ready for the next cyclic count operation of mechanical counter 16. The spring constant is very important to the operation of the fully mechanical counter counting apparatus 10. While the apparatus has been developed particularly for steam use and for application to steam power liquid pumps it is very desirable to have the mechanical counting apparatus operate with a 4 psi difference in spring force necessary to compress the spring from its fully extended and relaxed position shown in the drawing FIGS. 1–3, and a fully compressed condition where the ram head 52 mechanically drives the counter oscillation arm through its 60 degree rotational arc clockwise upwardly from the dotted line position shown at A, FIG. 2 to that shown in full lines at B. It is estimated that approximately one fourth of useful applications of the counter would be lost. The Applicant has determined therefore that by making the spring of 302 stainless steel and having a spring constant designed for a ram extension on the basis of a 10 psi differential, at the 10 psi minimum pressure the counter is highly suited to cover industry requirements to count cycles with high precision, at extreme pressure or back pressure against which the gas pressured power pump operates.

The hollow block or connector 14 is an excellent dissipator of heat to significantly reduce the temperature between the cylinder 20 and that of the counter 16 due to the large surface area for radiation of heat attempting to reach the counter and emanating from the steam pressure chamber 25. By making the block or connector 14 hollow, with substantial vertical wall structure and by thermally isolating the ram 28 from the oscillation arm of the counter and preventing direct contact therebetween by employing a molded plastic head to interrupt the metal content of the actuating elements, such heat isolation is further favorably influenced. As such, when the cylinder steam pressure chamber 25 sees the source of pressure at 29 momentarily in each cycle, the ram 28 extends against the bias of the coil spring briefly striking a counter oscillation arm which in turn trips the counter to increment the first wheel of the series of number wheels to indicate and record a pressure cycle which is registered on the counter. Further the presence of the ethylene propylene O-ring seal 36 ensures against leakage of steam past the piston 30 and reaching the bottom wall 58D of the cast aluminum thermal isolating connector or block 14 for heat conduction of temperatures in the order of 400 degrees Fahrenheit to the mechanical counter 16.

Further in contrast to the prior art diaphragm type counter actuators with the high friction in the actuator mechanism and the need for two external springs due to the short throw in the diaphragm and the requirement for a fairly heave biasing force, it is apparent that the mechanical counting apparatus in the various embodiments involves elements which neither touch or rest on the moving actuator element i.e., the ram 28 which uses its own biasing coil spring, with a spring bias force which is as low as possible to operate under systems with relatively low back pressure and one which relies on a full stroke of the ram 28 with all of the elements moving relatively freely, solely by the single stainless steel coil spring 38. Most importantly, while the apparatus has been purposely devised for a gas pressure source at 29 in the form of live steam, and where, the O-ring seal 36 is of EDPDM material, for the mechanical counter 16 to operate correctly one must address the back pressures against which the spring biased ram 28 must act or react which back pressure varies from application to application. If the back pressure is very low and under 10 psi the counters would simply not work since it is a requirement that the ram extend a full stroke against the bias of the coil spring whose spring constant is itself 10 psi from full extension to full retraction of the coil spring. As may be appreciated in the field in which the invention has particular application, if the spring required a spring force of 14 psi to fully extend the ram, about one quarter of the known applications would be lost, whereas with a 10 psi spring constant, very little applications are lost.

Figure 4:
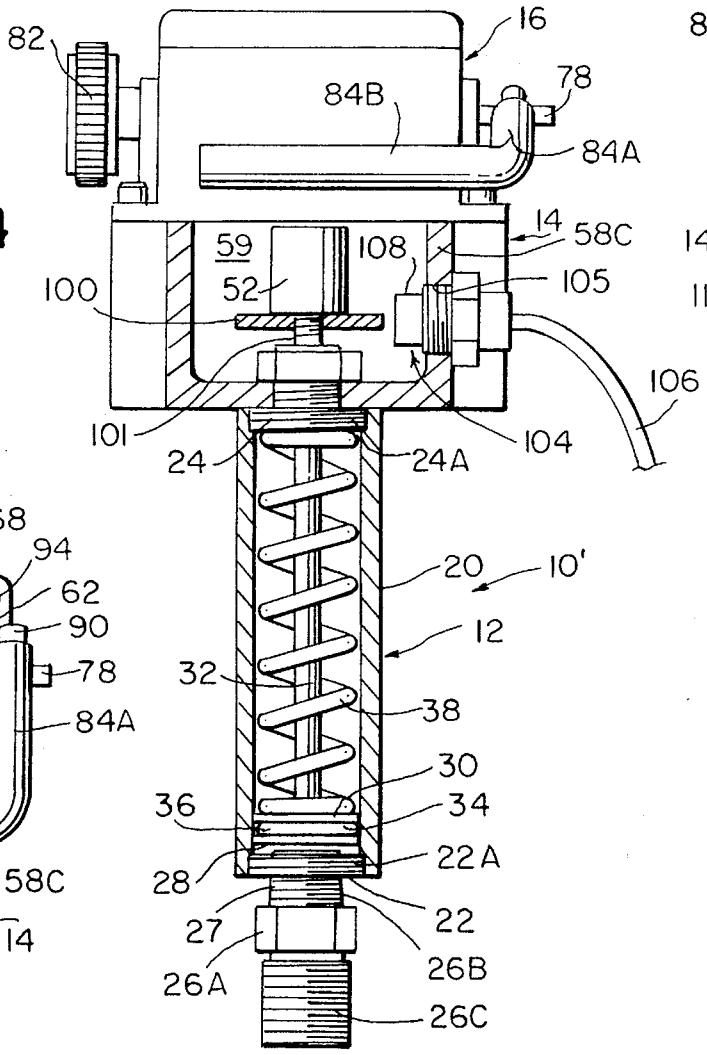

Referring next to FIG. 4, the mechanical counting apparatus indicated generally at 10' is quite similar to that of the first embodiment with the basic elements 12, 14 and 16 being identical to that embodiment. In this embodiment as well as the third embodiment of FIG. 5, like elements to that of the first embodiment bear like numeral designations. The mechanical counting apparatus 10' however, provides an additional signal output in the form of an electrical pulse preferably to an on-line computer for facilitating remote transmission of the cyclic count which cannot be effected by the purely mechanical counter 16 whose visual count, however, may be ascertained by viewing the position of the various number wheels 81 which are incremented one integer at a time by a ratchet action with the ability to reset all of the wheels to 0 by the counter wheel reset knob 82. In the instant embodiment, the piston rod whose upper end is threaded internally to a tapped bore of a cylindrical ram head 52, additionally carries permanent magnet disk 100 having a tapped bore 101. The permanent magnet is threaded onto the tapped end of the piston rod 32 prior to that of the head 52. Thus, as the piston 30 moves upwardly upon steam pressurization of chamber 25 against the bias of the coil spring 38, the permanent magnet 100 is raised to the same extent as the piston and moves relative to a magnetic sensor limit switch indicated generally at 104 and which is a cylindrical assembly projecting through a tapped hole 105 within sidewall 58C, FIG. 4. The cylindrical limit switch housing 108 houses a change of state switch contacts (not shown) which are normally closed when the permanent magnet is shown in the position of FIG. 4, with the coil spring 38 fully expanded and prior to the chamber 25 receiving a steam pressure charge sufficient to compress the coil spring to the full extent for cyclic movement of the mechanical counter oscillation arm 84 of the mechanical counter 16 identical to that of FIGS. 1–3. A pair of electrical leads 106 extend from the exterior of the hollow cast aluminum thermal insulating block or connector 14 and extend to a computer or like the piece of telecommunication equipment at a central location for storage of electrical pulse data in digital form over the leads 106 with one electrical pulse for each cyclic movement of the piston 30 of ram 28 from the fully retracted position shown to the fully extended position with the coil spring 38 fully compressed. While such magnetic sensor limit switches have been employed in the past to effect an electrical count, it is believed that the compact arrangement within the mechanical counting apparatus 10' as a second embodiment of the invention provides a novel structural combination having a great utility in the field of particular interest as described above.

Figure 5:
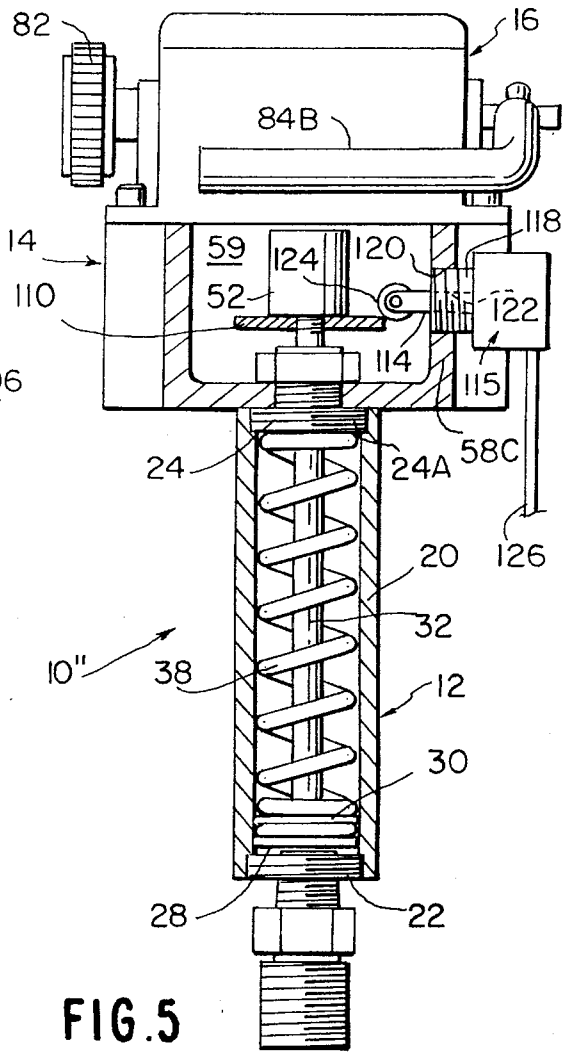
FIG. 5 is a vertical sectional view of a further embodiment of the invention in which the ram piston rod has fixed thereto a radially enlarged disk for mechanically contacting a limit switch plunger for effecting electrical pulses cyclically responsive to steam or other cyclic gas pressure increases acting on a spring-biased displaceable ram.

Turning next to FIG. 5, with like elements bearing like numeral designations, the mechanical counting apparatus 10" of this embodiment again utilizes a radially enlarged disk 110 as an actuator for a separate cycle sensor in addition to the oscillation arm 84 of the mechanical counter 16 as a backup beneath the ram head 52. The radially enlarged disk of metal or non-metal has a diameter in excess of that of the ram head 52 and is threaded to the threaded end of the piston rod 32 by way of a tapped bore 112. As such the radially enlarged disk 110 rides with the ram 28 through the full stroke necessary to accomplish incrementing of one of the wheels 81 within the counter 16, one integer, in the manner identical to that of the first and second embodiment. In this embodiment, a contact limit switch indicated generally at 115 is fixed to the sidewall 58C of the hollow cast aluminum thermal isolating block or connector 14 by way of an externally threaded pipe fitting 118 threaded into a tapped bore 120 of sidewall 58C. The fitting 118 includes a smooth axial bore 122 through which a plunger 114 passes. The plunger may carry a rotatable wheel or plunger head 124 which makes peripheral contact with the radially enlarged disk 110, such that the plunger is forced to retract to permit passage of the disk 110 whose periphery passes over the periphery of the plunger head or wheel 124. The result of this is to create a change of state of a pair of switch contacts (not shown) connected to the electrical leads 126 which may be connected at their opposite ends to a computer (not shown). In similar fashion therefore, an electrical pulse is created for each cyclic movement of the ram 28 as a result of gas pressurization of chamber 25, preferably by steam from source 29, through the axial bore of fitting 26 in the manner of the first and second embodiment to the extent of full compression of spring 38. In a preferred form, the spring constant of the spring 38 is 10 psi, such that a 10 psi steam pressurization of chamber 25 will result in full compression of the coil spring and a full extension of the ram 28 with retraction automatically occurring under the bias of the coil spring 38 at the termination of the pumping cycle of the liquid pump and the change of state of the dual valves within that pump (not shown).

Again, while known contact type limit switches have been employed for effecting the count of gas pressure driven actuators, it is believed that compact and simplified nature of the mechanical counting apparatus of the alternate embodiments 10' and 10" shows the effectiveness in integrating such contact limit switch or providing an electrical pulse count to a computer or like storage and control system, particularly where the mechanical counter apparatus may operate cyclically in excess of 5,000,000 cycles without damage or lack of accuracy over days, months or years of continuous counter use.

From the foregoing, it is seen that the present invention in the multiple embodiment form provides a steam impulse fully mechanical counting apparatus, which fully accomplishes the various objects set forth in the specification and is particularly adapted to meet the conditions of installation and use in the field of corrosive gas pressurization, particularly live steam at temperatures in excess of 400 degrees Fahrenheit, and for use in pumping liquids after cyclic accumulation within pressure vessels or reservoirs as a gas pressurized liquid pump, with the liquid being pumped being potentially corrosive to the elements particularly of the steam powered cyclic actuator 12 of the various embodiments.

Although the present invention has been described in detail with respect to the various embodiments illustrated herein, and constitutes examples for purposes of clarity of understanding, it is to be understood that various changes and modifications may be made within the spirit of the invention and the scope of the claims appended hereto.

What is claimed is:

1. A steam powered liquid pump holding mechanical cycle counting apparatus comprising:

a hollow, upwardly open actuator connector formed of a poor heat conducting metal and having a large heat radiating surface area, defined by a flat bottom wall, and integral sidewalls encircling a perimeter of the bottom wall and rising vertically from said bottom wall;

an actuator including a stainless steel metal cylinder closed off at opposite first and second ends, said first end being fixably mounted to a bottom of said bottom wall and extending downwardly therefrom;

a piston coaxially mounted within said cylinder for axial movement therein;

a stainless steel piston rod fixed to said piston and extending coaxially therefrom, and having an end remote from said piston projecting vertically outwardly of the first end of the cylinder mounted to said bottom wall;

a mechanical counter fixably mounted on said connector on edges of said integral sidewalls remote from said bottom wall laterally to a side of said end of said piston rod;

a stainless steel coil spring concentrically surrounding said piston rod and having a first end abutting a face of said piston and a second end abutting said first end of said cylinder proximate to said connector bottom wall for biasing said piston towards said second end of said cylinder, said mechanical counter including a movable arm extending in a path of the projecting end of said piston rod and adapted to increment said mechanical counter upon cyclic movement of said movable arm and means for coupling the second end of said closed cylinder to a source of pressurized steam whereby, said connector acts as a heat sink to dissipate heat from said steam acting on a face of said piston within a chamber defined by said cylinder, said second end of said cylinder remote from said connector bottom wall and said piston, wherein the end of the piston rod projecting through said connector bottom wall makes only momentary contact with said moveable arm of said mechanical counter thereby minimizing temperature rise within said mechanical counter.

2. The steam powered liquid pump holding mechanical cycle counter as claimed in claim 1, wherein said piston includes an arcuate groove within a periphery thereof, and an ethylene propylene O-ring seal is mounted within said circumferential groove within the periphery of the piston in compression contact with an inner surface of the cylinder so as to effectively prevent passage of the steam from said chamber across the periphery of the piston.

3. The steam powered liquid pump holding mechanical cycle counter as claimed in claim 1, wherein said connector is of cup shaped vertical cross-section, said bottom wall of said connector includes an axially tapped hole, said cylinder comprises at said opposite first and second ends respective first and second end caps, said first end cap has an exterior thread of cylindrical form, a diameter corresponding to said tapped axial hole within said connector bottom wall and is threaded thereto, said first end cap threaded portion extends through said bottom wall tapped hole, and a lock nut is threaded on a projecting threaded end of said first end cap thereby fixably coupling said hollow upwardly open actuator connector to said actuator.

4. The steam powered liquid pump mechanical cycle counting apparatus as claimed in claim 3, wherein said second end cap has a tapped axial bore and a brass steam inlet fitting having an axial bore includes an externally threaded portion cylindrically sized to and threaded to the tapped bore of said second end cap and constitutes said means for coupling the end of said cylinder remote from said connector bottom wall to said source of pressurized steam.

5. The steam powered liquid pump mechanical cycle counting apparatus as claimed in claim 4, wherein said hollow upwardly open actuator connector is formed of cast aluminum, said mechanical counter comprises a cast aluminum counter housing of generally parallelepiped form, having a flat metal base, fixably mounted to an upper peripheral edge of the cast aluminum actuator connector sidewall and spanning therebetween and being offset laterally from the end of said piston rod projecting through said connector bottom wall into a hollow interior of said connector, said counter housing includes a cover overlying a set of incrementally rotatable wheels mounted on a rotary shaft extending horizontally through the interior of the counter housing, from one end to the other, a narrow resetting knob is fixed to one end of said shaft at one side of the counter housing, an L-shaped oscillation arm is fixably mounted to another end of said shaft projecting through an opposite side of said counter housing said L-shaped oscillation arm having a radial portion projecting downwardly and outwardly and terminating in an integral right angle horizontal arm portion which spans across an open upper end of said hollow cast aluminum connector in the path of movement of said end of said piston rod projecting through said bottom wall of said connector, whereby; as a result of the pressure increase within said chamber of said actuator cylinder, said piston is driven upwardly against the bias of said stainless steel coil spring cyclically to drive said oscillation arm through a limited angular rotation sufficient to increment one of said wheels to record one cycle of operation of said steam powered liquid pump.

6. The steam powered liquid pump mechanical cycle counting apparatus as claimed in claim 5, wherein the end of said piston rod projecting into said hollow cast aluminum connector has fixed thereto, a ram head of a non-heat conducting material to thermally isolate the stainless steel piston rod from the oscillation arm of the counter and to limit heat transfer between the piston rod and the mechanical counter mounted to a peripheral edge of the connector vertical sidewalls.

* * * * *